US008757586B2

(12) United States Patent
Gruen et al.

(10) Patent No.: US 8,757,586 B2
(45) Date of Patent: Jun. 24, 2014

(54) SOLENOID ARRANGEMENT AND VALVE ARRANGEMENT

(75) Inventors: Juergen Gruen, Lohr am Main (DE); Horst Bartel, Lohr am Main (DE); Roland Schempp, Vaihingen (DE); Klemens Strauss, Frammersbach (DE)

(73) Assignee: Robert Bosch GmbH, Stuttgart, DE (US)

( * ) Notice: Subject to any disclaimer, the term of this patent is extended or adjusted under 35 U.S.C. 154(b) by 815 days.

(21) Appl. No.: 13/056,463

(22) PCT Filed: Jul. 20, 2009

(86) PCT No.: PCT/EP2009/005250

§ 371 (c)(1),
(2), (4) Date: Feb. 24, 2011

(87) PCT Pub. No.: WO2010/012394

PCT Pub. Date: Feb. 4, 2010

(65) Prior Publication Data

US 2011/0147629 A1 Jun. 23, 2011

(30) Foreign Application Priority Data

Jul. 29, 2008 (DE) ..... 10 2008 035 332

(51) Int. Cl.
*H01F 7/16* (2006.01)

(52) U.S. Cl.
USPC ..... 251/129.15; 335/261; 335/279; 335/281; 335/298

(58) Field of Classification Search
USPC ..... 251/129.15; 335/261, 279, 281, 297, 335/298
See application file for complete search history.

(56) References Cited

U.S. PATENT DOCUMENTS

| | | | | | |
|---|---|---|---|---|---|
| 2,407,963 | A | * | 9/1946 | Persons | 335/261 |
| 3,168,242 | A | * | 2/1965 | Diener | 335/261 |
| 4,604,600 | A | * | 8/1986 | Clark | 335/261 |
| 5,234,265 | A | * | 8/1993 | Tyler | 303/119.2 |
| 5,306,076 | A | * | 4/1994 | Tyler | 137/625.65 |
| 5,318,354 | A | * | 6/1994 | Tyler | 303/3 |
| 5,467,961 | A | * | 11/1995 | Sausner et al. | 251/129.15 |
| 5,547,165 | A | | 8/1996 | Brehm et al. | |
| 5,565,832 | A | * | 10/1996 | Haller et al. | 335/249 |
| 6,268,784 | B1 | * | 7/2001 | Feigel et al. | 335/261 |
| 6,397,891 | B1 | * | 6/2002 | Neuhaus et al. | 251/129.08 |
| 6,877,717 | B2 | * | 4/2005 | Collins et al. | 251/129.15 |
| 7,350,763 | B2 | * | 4/2008 | Hofling | 251/129.15 |
| 2005/0166979 | A1 | | 8/2005 | Berger et al. | |

FOREIGN PATENT DOCUMENTS

| | | | |
|---|---|---|---|
| DE | 4329760 | A1 | 3/1995 |
| DE | 102004004708 | B3 | 4/2005 |
| EP | 1855296 | A2 | 11/2007 |
| JP | 9306731 | A | 11/1997 |

* cited by examiner

*Primary Examiner* — John Bastianelli
(74) *Attorney, Agent, or Firm* — Maginot, Moore & Beck

(57) ABSTRACT

A solenoid arrangement comprises a pole tube which is axially subdivided into a pole core section, a transition section, and a tube section. A magnetic flux between the pole core section and the tube section is interrupted by the transition section. An armature is movably guided in the pole tube and has, at its end facing the pole core section, a flange which axially projects from an end face. According to the invention, the pole core section has a stepped depression into which the armature can plunge and which, starting from the transition section, is subdivided into an annular collar, a shoulder, and a notch which is set back axially and radially. An axial dimension of the collar exceeds an axial dimension of the flange.

20 Claims, 2 Drawing Sheets

SOLENOID ARRANGEMENT AND VALVE ARRANGEMENT

CROSS-REFERENCE TO RELATED APPLICATION

This application is a 35 USC 371 application of PCT/EP 2009/005250 filed on Jul. 20, 2009.

BACKGROUND OF THE INVENTION

1. Field of the Invention

The invention relates to a solenoid arrangement. The invention also relates to a valve arrangement.

2. Description of the Prior Art

One such solenoid arrangement is known from German Patent Disclosure DE 197 07 587 A1. A pressure-proof solenoid has, in addition to the pole tube, a coil for actuating an armature that is axially movably guided in an armature chamber of the pole tube. The pole tube essentially comprises the following: a pole piece—also called a pole core—which can be screwed into a valve housing via a central thread; a nonmagnetic adapter piece; and a tubular piece, which adjoins the adapter and is closed on the face end, on the side remote from the pole piece, by means of a component acting as a stroke limiter. The pole piece, the adapter piece, the tube piece, and the stroke limiter define the armature chamber for the armature that cooperates with the coil. The armature is connected to a tappet, which penetrates the pole piece in the axial direction and serves to actuate a valve slide of a hydraulic valve. The nonmagnetic adapter piece serves to divert the magnetic flux into the armature. This nonmagnetic adapter piece can be embodied in annular-conical form, for attaining a favorable characteristic force-travel curve. In the production, however, such shaping involves effort and expense. Especially in simply switching magnets, the simplest possible geometry of the adapter piece should be employed in the production.

Examples for how an armature in cooperation with a pole piece can be contoured are given in German Patent Disclosure DE 103 27 875 B4. However, in terms of production, this discloses pole pieces of quite complicated shape.

In conventional, easy to manufacture solenoids, the characteristic force-travel curve at present usually does not have an optimal course. Specifically, for actuating hydraulic switching valves or proportional valves, even at short to medium strokes of the control piston, strong flow forces, oriented counter to the actuation, must be overcome and they increase only slightly in the further course of the stroke. Moreover, the flow forces are often effective over only a narrowly defined portion of the stroke. Conversely, conventional solenoids develop a strong force only in the final portion of the stroke. Aside from this, the force development is not very localized and is usually embodied as uniform or with a slight ascending slope over a wide stroke range. This requires large solenoids, with correspondingly high consumption of material and energy.

OBJECT AND SUMMARY OF THE INVENTION

It is therefore the object of the present invention to disclose an improved solenoid arrangement which can be adapted structurally in a simple way to the actuation force characteristic curve of a valve.

This object is attained by a solenoid arrangement according to the invention.

The embodiment of a bolster on the armature and of a graduated indentation in the pole core, with a countersunk feature for receiving the bolster, can be achieved in manufacture by simple means. The greater length of the collar in comparison to the bolster on the armature has the effect that over the stroke course of the armature in the actuation operation, edges and boundary lines or boundary faces of the pole piece come into coincidence, in succession and spaced apart from one another, with corresponding segments of the armature. First, coincidence occurs between a face-end inner boundary line of the collar and end face of the armature. As the stroke continues, the bolster then plunges into the countersunk feature, moving past a shoulder of the indentation. In this way, the characteristic force-stroke curve can be designed such that over a defined portion of the stroke, namely along the course of the armature between the two edges, a targeted plateau-like elevation of the force occurs. The solenoid arrangement according to the invention is simple in construction and can be produced favorably. It can be adapted optimally to the flow force characteristic curves, for instance of switching valves. By means of the structural form described, the force even decreases again in the end region of the armature stroke, or in other words after the bolster plunges into the countersunk feature. This contributes to reduced stress on the nonstick disk, to less switching noise, and to a faster switching time. Overall, with the valve arrangement of the invention, at less electrical power, greater valve forces or flow forces can be overcome, and switching valves in particular can be actuated safely and efficiently.

Accordingly, the object is also attained by a valve arrangement which has a solenoid arrangement of this kind.

In particular, the valve is combined with a solenoid arrangement that in its characteristic curve is adapted optimally to the flow force conditions of the valve. The adaptation is effected structurally simply, by way of the geometric length ratios of the collar and bolster. In a clear way, the location of the aforementioned edges, for instance, is adapted to the course of the opening cross section of the valve along the actuation stroke.

In an advantageous feature of the present invention, the transition segment is formed of a nonmagnetic material, and a separation segment between the transition segment and the collar is oriented essentially perpendicular to a center axis of the pole tube. Precisely with such simply geometries at the separation segment, characteristic curves that are well adapted to a valve can be attained by means of the embodiment according to the invention of the armature and the pole core segment. It is especially simple to manufacture, for instance using resistance welding—such as capacitor discharge welding or medium-frequency welding—for joining the pole piece and the separating ring that forms the transition segment.

Preferably, a nonstick disk is disposed between the end face of the armature and the shoulder of the pole piece. A comparatively large area is available there, so that the nonstick disk withstands even heavy loads. The nonstick disk could even be drawn over onto the bolster and thus rest in captive fashion on the end face of the armature.

The described geometry at the armature and the pole core segment can also be utilized to damp an impact of the armature on the pole core. To that end, a radial gap between the bolster and the countersunk feature is dimensioned correspondingly narrowly. The fluidic damping is then effected via the positive displacement of fluid out of an outer annular chamber between the armature—or more precisely its end face and the bolster—and the shoulder of the indentation.

Preferably, in a valve arrangement having the solenoid arrangement of the invention, a first position of the armature, in which position the end face of the armature is facing a boundary line of the end face of the collar, is equivalent to a slight degree of opening of the valve, or in other words to a position of the valve piston at which flow forces become definitive. A second position of the armature, at which an end face of the bolster of the armature is facing the shoulder of the indentation, is equivalent to a greater degree of opening of the valve, at which the valve piston has already nearly completed its opening stroke and in which the flow forces are receding again. This can for instance be from 25% to 75% of the opening stroke of the valve piston.

BRIEF DESCRIPTION OF THE DRAWINGS

The present invention and its advantages will be described in further detail below with reference to the exemplary embodiment shown in the drawings.

DESCRIPTION OF THE PREFERRED EMBODIMENT

Figure 1:
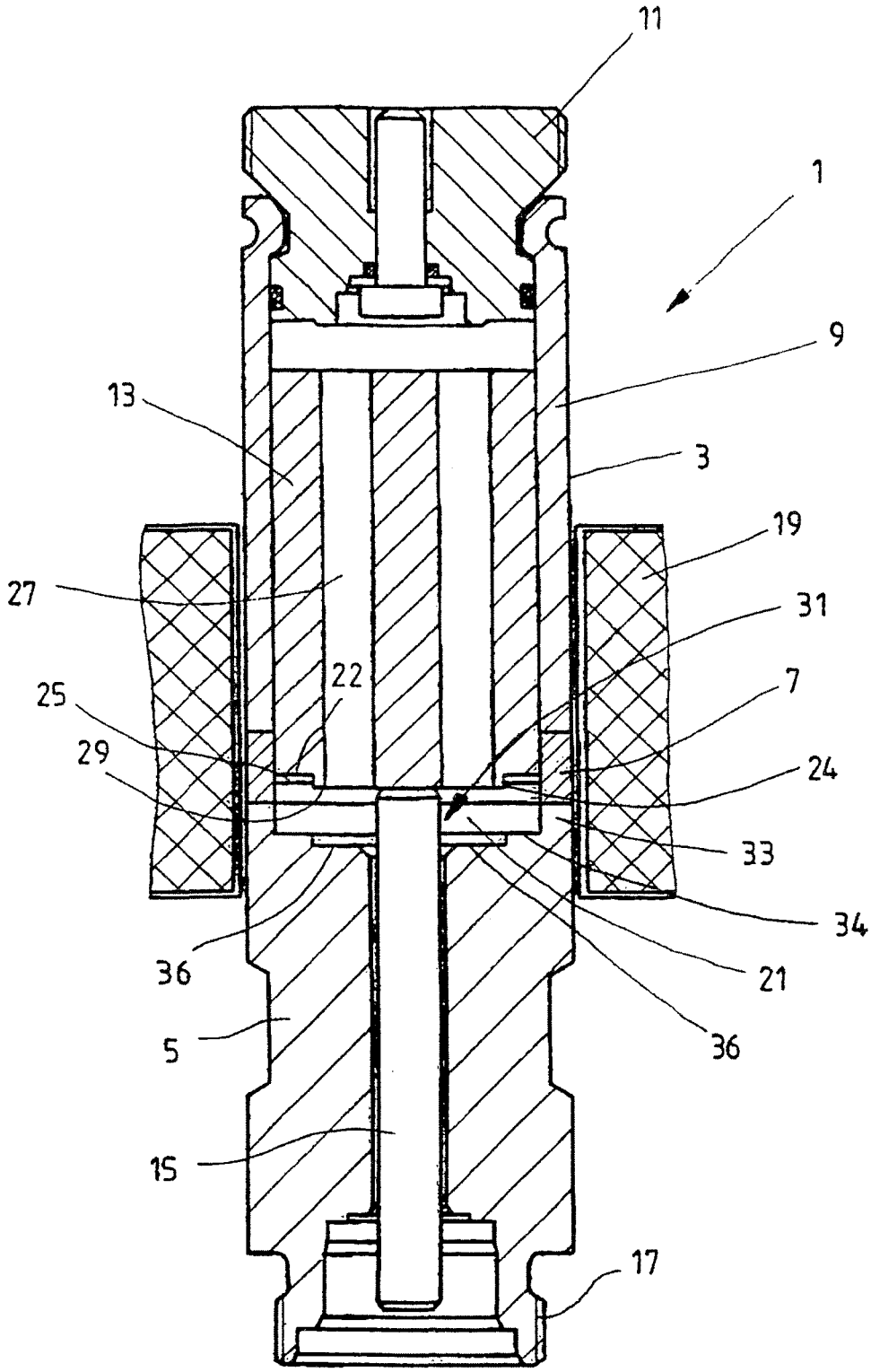
FIG. 1 shows a solenoid arrangement in a schematic sectional view.

In FIG. 1, a solenoid arrangement 1 for actuating a valve slide of a hydraulic valve (not shown) is shown. The solenoid arrangement 1 has a fluid-tight pole tube 3. The pole tube 3 has a pole core segment 5, a separation segment 7—in the claims also called a transition segment—a tube segment 9, and a closure piece 11—also called a stroke limiter. The pole core segment 5, separation segment 7, tube segment 9, and closure piece 11 form a circular-cylindrical receiving chamber for an armature 13. A tappet 15 is guided in the pole core segment 5 and protrudes from it on the outer face end of the pole core segment 5.

By means of a thread 17 on the pole core segment 5, the pole tube 3 is screwed into a valve housing of the hydraulic valve. A coil component is slipped onto the pole tube 3. It includes the actual coil 19 as well as a housing of magnetic material (not shown), which acts as a yoke for a magnetic circuit that includes the pole tube 3. The separation segment 7 interrupts the magnetic circuit in the vicinity of the working air gap 21 between the armature 13 and the pole core segment 5 and forces the magnetic field lines to transfer from the pole core segment 5 to the armature 13.

The armature 13, on its face end toward the pole core segment 5, is provided with a bolster 24 that protrudes from the end face 22. A nonstick disk 25 is placed on the circular-annular end face 22. This nonstick disk, for securing, can optionally be drawn onto the bolster 24. Axial fluid compensation conduits 27 penetrate the armature 13. They discharge at an end face 29 of the bolster 24.

The pole core segment, on its inside, has a graduated indentation 31 for receiving the armature portion oriented toward it. This indentation 31 is divided up as follows: A collar 33 protrudes in circular-annular fashion past an inner end face 34 of the pole core segment 5. The end face 34 also forms a shoulder for a central countersunk feature 36.

The inside diameter of the collar 33 is equivalent to the inside diameter of the separation segment 7 and to the inside diameter of the tube segment 9. The inside diameter of the countersunk feature 36 is selected such that the bolster 24 can plunge into the countersunk feature 36. Via a gap between the bolster 24 and the countersunk feature 36, fluidic damping of the armature motion in the terminal position can be attained. The damping volume is located in an annular chamber that is defined by the bolster 24, the end face 22, the end face 34, and the collar 33.

Figure 2:
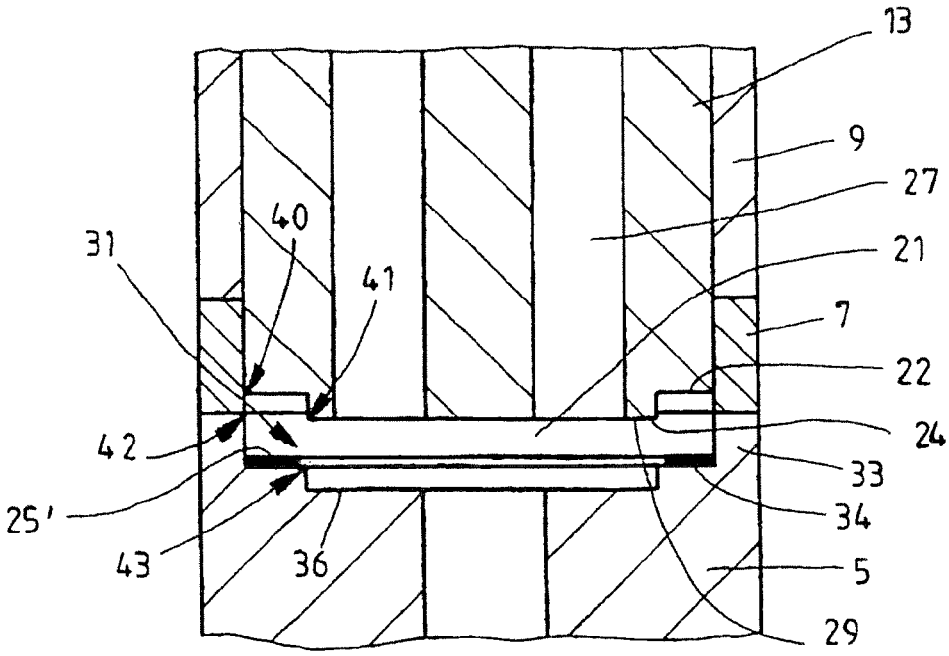
FIG. 2 shows an detail of FIG. 1 around the region of the working air gap.

The region around the working air gap 21 is shown enlarged in FIG. 2. The essentially circular-tubular form of the separation segment 7, which has no cone, can be seen. A pole tube 3 with this kind of separation segment can be joined together from tubular or cup-shaped semifinished products, for instance by means of electrical resistance welding. The nonstick disk 25' shown is a variant of that in FIG. 1. The nonstick disk 25' is placed in the working air gap 21 and rests on the end face 34. It can optionally be secured there.

The bolster 24 is defined on its face end by an outer annular edge 41. There is also an annular edge 40 at the transition from the end face 22 of the armature into the jacket face of the armature. An imaginary, circular boundary line 42 is located at the transition from the collar 33 to the separation segment 7, and at this line the magnetizability of the pole tube 3 changes abruptly in its axial course. Between the end face 34 and the countersunk feature 36, the annular edge 43 is present in the graduated indentation 31 of the pole core segment 5. This annular edge can be chamfered or rounded.

Figure 3:
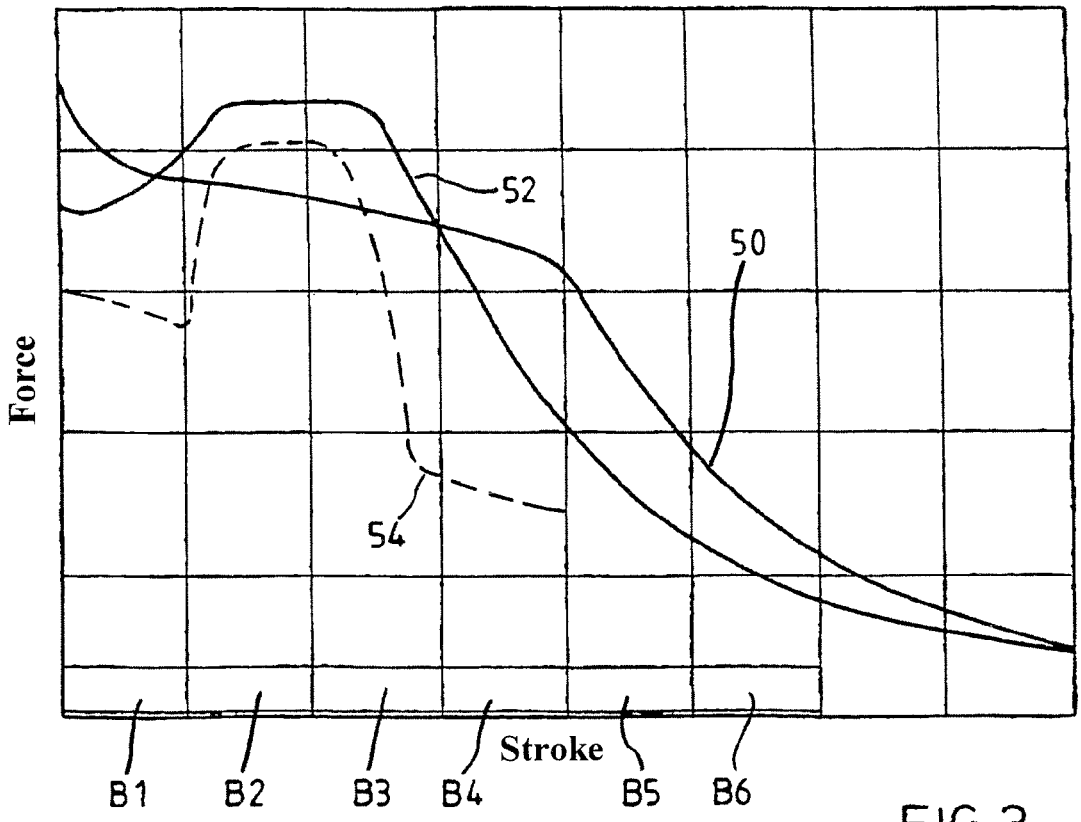
FIG. 3 shows a characteristic curve of the solenoid arrangement of the invention, in comparison with a flow force characteristic curve of a valve and a characteristic curve of a conventional solenoid.

FIG. 3 shows a characteristic force-stroke curve 50 of a conventional solenoid arrangement, for instance an actuation magnet, of the kind described in DE 197 07 587 A1 referred to at the outset; a characteristic force-stroke curve 52 of the solenoid arrangement 1 of the invention; and an characteristic actuation force-stroke curve 54 (in dashed lines) of a typically directly actuated switching valve of the rated size 6 or 10. The stroke is subdivided into ranges B1 through B6. The length of the ranges is on the order of magnitude of 1 to 2 mm each, for example. The characteristic curve 54 of the valve has a basic line, which rises to the range B1 and is dictated by the usual action of a restoring spring on the valve piston and by the friction of the valve piston in the valve bore. However, the flow forces acting on the valve piston in the opening operation have a major effect on the characteristic curve 54. They cause the sharp rise, which can be seen in the ranges B2 and B3 of the characteristic curve 54, in the requisite actuation force. After the valve has been connected fully through, flow forces are no longer definitive, as the curve 54 in the range B1 shows.

Upon an electrical actuation of the solenoid arrangement 1 by a supply of current to the coil 19, the following procedure takes place: From a terminal position at the closure piece 11 or from contact with the tappet 15—as shown in FIG. 1—the armature 13 begins to move in the direction of the pole core segment 5. The motion begins in the range B6 or at the transition from the range B5 to the range B4—in this case contact with the tappet 15 occurs—with initially low force, as indicated by the line 52. The range B3 is the portion of the course of motion at which the annular edge 40 of the armature 13 crosses over the boundary line 42 with the collar. Between the annular edge 40 and the boundary line 42, there is a high density of magnetic field lines in the working air gap. When the armature 13 with the annular edge 40 plunges into the collar 33, a pronounced decrease occurs in the magnetic field energy present in the working air gap. As a result, the characteristic curve 52 rises steeply from the range B4 to the range B3.

Once the armature 13 has passed the boundary line 42, a further range of high field line density is present between the annular edge 41 at the bolster 24 of the armature 13 and the annular edge 43 of the graduated indentation 31. As the armature 13 plunges to an increasing extent into the graduated indentation 31, the high force can therefore be maintained, until the armature plunges, with the bolster 24, into the countersunk feature 36. This can be seen in the characteristic curve 52 in the range B2 and at the transition from the range B2 to the range B1. Over the further course of the armature 13, only the volume, filled with only a few magnetic field lines, in the countersunk feature 36 is now reduced. The force accordingly drops in the range B1. The motion ends when the armature 13, with the nonstick disk 25 or 25', rests on the end face 34. A gap remains between the end face 29 of the bolster 24 and the bottom of the countersunk feature 36.

By the selection of the axial disposition of the boundary line 42 and the annular edge 43, or in other words of the length of the collar 33, and by means of a suitable length of the bolster 24, a plateau-like increase in the magnetic force can thus be attained over a comparatively wide stroke range in the characteristic force-stroke curve 52 of the solenoid arrangement 1. The difference in length between the collar 33 and the bolster 24 approximately produces the length of the plateau of the characteristic force-stroke curve 52 in the ranges B2 and B3. For that purpose, at the beginning and in the end phase of the armature stroke—the ranges B4 through B6 and the range B1—the magnetic force is correspondingly reduced—in each case in comparison to the characteristic curve 50 of a conventional magnet with the same electrical power.

The solenoid arrangement 1 described is excellently well suited for actuating a switching multiposition valve. The typical actuation force characteristic curve 54 on the stroke of the valve slide, as noted, has a significant increase because of flow forces upon the enlargement of the opening cross section, until full valve opening is attained. This can be seen as a plateau in the actuation force in the ranges B2 and B3 of the characteristic curve 54. By means of the length of the bolster 24 and the collar 33, among other ways, the solenoid arrangement 1 is now designed such that the plateau of the actuation force in the characteristic curve 54 is covered by the plateau-like increase in the magnetic force in the characteristic curve 52. Thus over each portion of the armature stroke, sufficient magnetic force for securely connecting the valve through exists. Because of the steep rise in the magnetic force in the range B4 of the characteristic curve 52, sufficient magnetic force is also present even at the beginning of the stroke of the valve slide, when the prestressing of the restoring spring has to be overcome. The decrease in magnetic force in the range B1 coincides with the decrease in the flow forces once the valve has been connected fully through. Moreover, because of the decrease in force, the nonstick disk 25 or 25' is less severely stressed by the impact of the armature 13 striking it. The impact noise is slight as well. The armature 13 returns to its outset position faster after the coil 19 has been shut off.

The use of the solenoid arrangement of the invention has been described in terms of the exemplary embodiment for a switching multiposition valve for performing the opening stroke that is closed when with current. It is understood that it can also be employed with a switching multiposition valve for performing the closing stroke that is open when without current. The solenoid arrangement of the invention can furthermore be used for actuating a proportional valve as well. Then a plurality of bolsters disposed in stages can also be provided on the armature, and a correspondingly multiply graduated indentation on the pole piece, which indentation receives the bolsters each in suitable countersunk features, can be employed.

A further variant is to embody the collar 33 conically. Then, as a result of the above-described shape of the armature 13 with the bolster 24 and of the graduated indentation 31, the proportional range can be extended over a wider stroke range.

The foregoing relates to the preferred exemplary embodiment of the invention, it being understood that other variants and embodiments thereof are possible within the spirit and scope of the invention, the latter being defined by the appended claims.

The invention claimed is:

1. A solenoid arrangement, comprising:

a pole tube, which is divided up axially into a pole core segment, a transition segment, and a tube segment, and by means of the transition segment, a magnetic flux between the pole core segment and the tube segment is interrupted; and an armature guided movably in the pole tube, which armature, on its face end toward the pole core segment, has a bolster protruding axially from an end face of the armature, the pole core segment having a graduated indentation, into which the armature can plunge and which indentation, beginning at the transition segment, graduates into an annular collar, a shoulder, and an axially and radially set-back countersunk feature, wherein an axial measurement of the collar exceeds an axial measurement of the bolster.

2. The solenoid arrangement as defined by claim 1, wherein the transition segment is formed of a nonmagnetic material, and a separation segment between the transition segment and the collar is oriented essentially perpendicular to a center axis of the pole tube.

3. The solenoid arrangement as defined by claim 1, wherein a nonstick disk is disposed on the end face of the armature.

4. The solenoid arrangement as defined by claim 2, wherein a nonstick disk is disposed on the end face of the armature.

5. The solenoid arrangement as defined by claim 1, wherein a nonstick disk is disposed on the shoulder of the indentation.

6. The solenoid arrangement as defined by claim 2, wherein a nonstick disk is disposed on the shoulder of the indentation.

7. The solenoid arrangement as defined by claim 1, wherein a ratio of the axial measurement of the bolster and the axial measurement of the collar is between 1:2 and 1:4, for example being 1:2, 1:3, or 1:4.

8. The solenoid arrangement as defined by claim 2, wherein a ratio of the axial measurement of the bolster and the axial measurement of the collar is between 1:2 and 1:4, for example being 1:2, 1:3, or 1:4.

9. The solenoid arrangement as defined by claim 3, wherein a ratio of the axial measurement of the bolster and the axial measurement of the collar is between 1:2 and 1:4, for example being 1:2, 1:3, or 1:4.

10. The solenoid arrangement as defined by claim 5, wherein a ratio of the axial measurement of the bolster and the axial measurement of the collar is between 1:2 and 1:4, for example being 1:2, 1:3, or 1:4.

11. The solenoid arrangement as defined by claim 1, wherein a radial gap between the bolster and the countersunk feature is dimensioned such that a motion of the armature toward a terminal position on the pole core segment is fluidically damped.

12. The solenoid arrangement as defined by claim 10, wherein a radial gap between the bolster and the countersunk feature is dimensioned such that a motion of the armature toward a terminal position on the pole core segment is fluidically damped.

13. A valve arrangement, comprising:

a housing;

a valve slide guided movably inside the housing in a valve bore, by which a control cross section of a fluidic communication of the valve slide is adjustable; and a solenoid arrangement as defined by claim 1, which is provided for actuating the valve slide.

14. A valve arrangement, comprising:

a housing;

a valve slide guided movably inside the housing in a valve bore, by which a control cross section of a fluidic communication of the valve slide is adjustable; and a solenoid arrangement as defined by claim 12, which is provided for actuating the valve slide.

15. The solenoid arrangement as defined by claim 13, wherein a first position of the armature, at which position the end face of the armature is facing an inner boundary line, toward the transition segment, of the collar, and a second position of the armature, in which position an end face of the bolster of the armature is facing the shoulder of the indentation, are disposed in accordance with an expected force profile of flow forces acting on the valve slide in an opening operation.

16. The solenoid arrangement as defined by claim 14, wherein a first position of the armature, at which position the end face of the armature is facing an inner boundary line, toward the transition segment, of the collar, and a second position of the armature, in which position an end face of the bolster of the armature is facing the shoulder of the indentation, are disposed in accordance with an expected force profile of flow forces acting on the valve slide in an opening operation.

17. The solenoid arrangement as defined by claim 15, wherein the first position of the armature is equivalent to a lesser degree of opening of the control cross section, and the second position of the armature is equivalent to a comparatively greater, in particular nearly completely open, control cross section.

18. The solenoid arrangement as defined by claim 16, wherein the first position of the armature is equivalent to a lesser degree of opening of the control cross section, and the second position of the armature is equivalent to a comparatively greater, in particular nearly completely open, control cross section.

19. The solenoid arrangement as defined by claim 15, wherein the first position of the armature is equivalent to a stroke of 20% to 40%, in particular 25%, of the stroke, associated with the opening operation, of the valve slide, and the second position of the armature is equivalent to a stroke of 60% to 85%, in particular 75%, of the stroke, associated with the opening operation, of the valve slide.

20. The solenoid arrangement as defined by claim 17, wherein the first position of the armature is equivalent to a stroke of 20% to 40%, in particular 25%, of the stroke, associated with the opening operation, of the valve slide, and the second position of the armature is equivalent to a stroke of 60% to 85%, in particular 75%, of the stroke, associated with the opening operation, of the valve slide.

* * * * *